US008985735B2

(12) United States Patent
Fernandez del Rio et al.

(10) Patent No.: US 8,985,735 B2
(45) Date of Patent: Mar. 24, 2015

(54) DEPOSITION OF PRINT TREATMENT

(71) Applicant: Hewlett-Packard Development Company, L.P., Houston, TX (US)

(72) Inventors: Jaime Fernandez del Rio, San Diego, CA (US); Eduardo Amela Conesa, Granyena de Segarra Lleida (ES); Jacint Humet Pous, Barcelona (ES); Marc Serra Vall, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 13/852,433

(22) Filed: Mar. 28, 2013

(65) Prior Publication Data

US 2014/0292843 A1 Oct. 2, 2014

(51) Int. Cl.
*B41J 2/015* (2006.01)
*B41J 2/21* (2006.01)

(52) U.S. Cl.
CPC ..... *B41J 2/2114* (2013.01); *B41J 2/2132* (2013.01)
USPC ..... 347/21

(58) Field of Classification Search
None
See application file for complete search history.

(56) References Cited

U.S. PATENT DOCUMENTS

| | | | |
|---|---|---|---|
| 6,598,965 | B1 | 7/2003 | Lund et al. |
| 6,655,797 | B2 | 12/2003 | Smith et al. |
| 7,364,266 | B2 | 4/2008 | Konno |
| 7,422,300 | B2 | 9/2008 | Yamanobe |
| 8,220,913 | B2 | 7/2012 | Ooishi et al. |

OTHER PUBLICATIONS

Provost, J., et al., Ink-Textile Interactions in Ink Jet Printing—The Role of Pretreatments, Dec. 4, 2003, http://provost-inkjet.com/resources/SDC++Ink+JetPretreatment+4th+Dec+03.pdf.

*Primary Examiner* — Justin Seo
(74) *Attorney, Agent, or Firm* — Hewlett-Packard Patent Department

(57) ABSTRACT

The present disclosure is related to deposition of print treatments. In an example, treatment is to be deposited on substrate dot locations to receive ink according to selected treatment-to-ink regimes. The selected treatment-to-ink regimes include a variable treatment-to-ink regime and a constant treatment-to-ink regime. The variable treatment-to-ink regime is for depositing a variable amount of treatment dependent on the amount of ink to be deposited in a substrate dot location when the ink amount in the substrate dot location is below a threshold. The constant treatment-to-ink regime is for depositing a selected constant amount of treatment in a substrate dot location and an area surrounding the substrate dot location when the ink amount in the substrate dot location is above the threshold. Other examples are illustrated herein.

9 Claims, 6 Drawing Sheets

DEPOSITION OF PRINT TREATMENT

BACKGROUND

Some printing systems form a printed image by ejecting printing fluids from printheads. Thereby, printing fluids, such as treatment fluids and inks, are applied onto a print medium for printing a pattern of individual dots at particular locations. The printed pattern reproduces an image on the printing medium. At least some of these printing systems are commonly referred to as inkjet printers.

A treatment fluid may be used for enhancing print quality of a printed pattern. For example, a pre-treatment fluid (e.g., a fixer) may be applied on a substrate location prior to ink deposition for addressing coalescence, bleed, feathering, or similar effects caused by ink or pigment migration across the printed surface. Alternatively, or in addition thereto, a post-treatment fluid (e.g. a coating), may be applied on a substrate location after ink deposition for protecting the printed pattern.

Common methods for applying a treatment fluid include roll coating, spray coating, manual application or treatment ejection.

BRIEF DESCRIPTION OF THE DRAWINGS

In order that the present disclosure may be well understood, various examples will now be described with reference to the following drawings.

DETAILED DESCRIPTION

Figure 1:
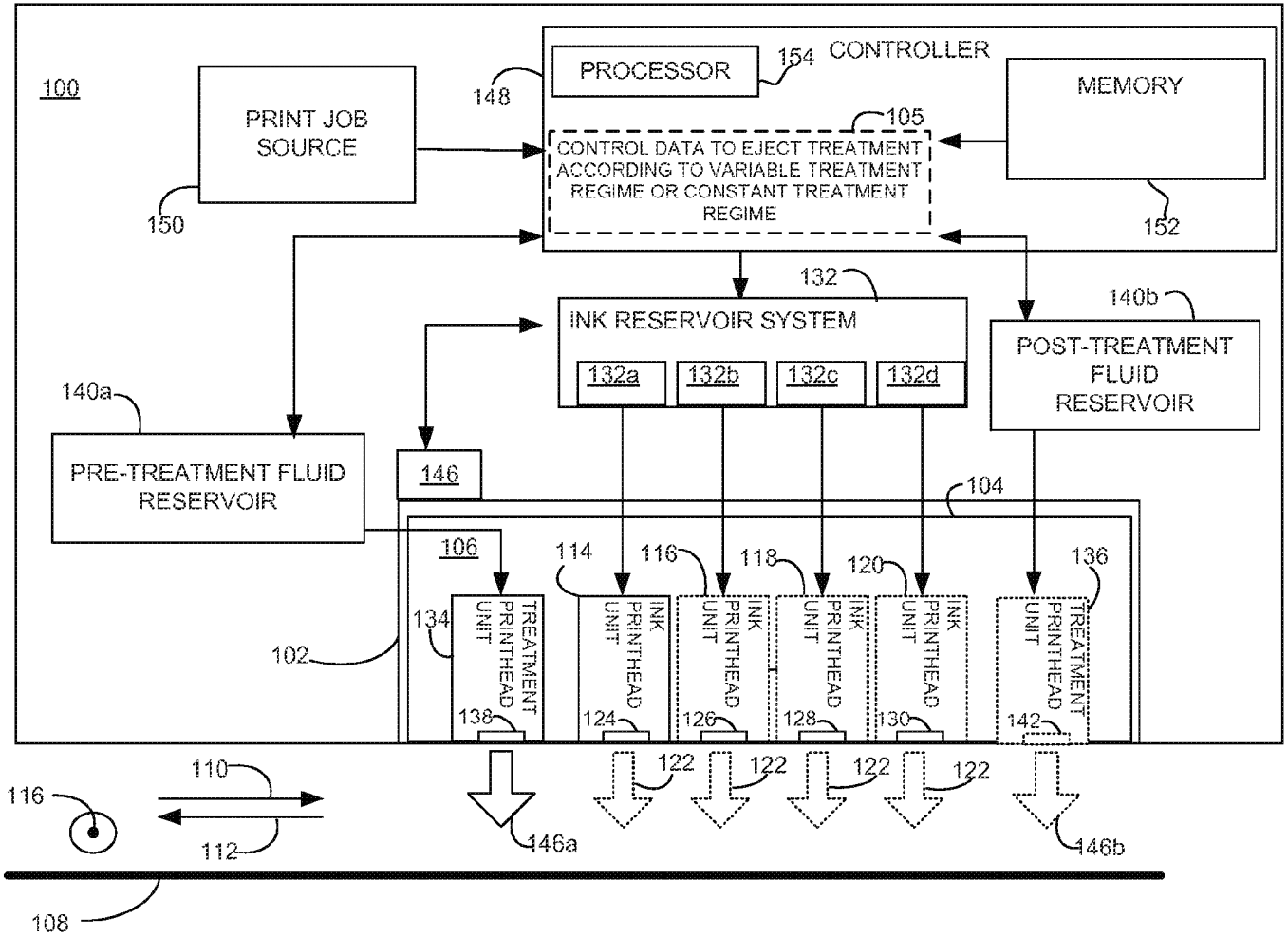
FIG. 1 is a block diagram schematically illustrating a printing system in which examples can be implemented.

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Similar or equal elements in the Figures may be indicated using the same numeral.

An image may be reproduced on a substrate by printing a pattern of individual dots. Inkjet printers print dots by ejecting very small drops of ink onto the print medium via one or more printheads each having ink ejecting nozzles as set forth below with respect to FIG. 1.

Print quality is one of the most important considerations in printing. Since the image output of an inkjet printer is formed of thousands of individual ink drops, the quality of the image is dependent upon the quality of each ink drop and the arrangement of the ink drops on the print medium.

One common problem that may degrade quality of a printed image is ink migration across the substrate onto which it is deposited. This might cause a lack of edge sharpness. In an ideal environment, ink drops would form a perfect circle of uniform size when applied to a medium. However, it is common for ink drops to bleed or feather into surrounding areas when applied to a medium. If the surrounding area is a non-ink area, then the resulting image will not have a well-defined edge. If the surrounding area is another ink drop, then the colors of the two ink drops may combine, producing a different undesirable color. In either case, the quality of the image may be seriously degraded. The printing artifacts may be respectively referred to as bleeding and feathering.

Ink migration may cause other artifacts such as coalescence, in which ink droplets on the substrate may merge. Merged ink droplets may form pools and puddles that, when drying, may cause visible non-uniformities.

Another common problem that may affect printing is slow drying of ink. For example, after printing of a page is complete, the printer may need to hold a page for letting the ink drying before depositing the page in an output tray. This may place an undesirable limit on how fast consecutive pages can be printed.

Another problem that may appear is poor water fastness. After ink dries on a substrate, it might be desirable to maintain the integrity of the image even if a small amount of moisture, such as perspiration from one's hand, is applied to the image. If the image has poor water fastness, moisture may cause the ink to bleed or run, thereby seriously degrading the printed image.

Another problem that may appear once an inked pattern is printed on substrate is susceptibility to scratches or rubbing that may degrade print quality.

For addressing the above problems, some approaches have been employed.

One approach is to use special inks that will either react with each other or with the medium to improve edge sharpness and ink adherence to the substrate. This approach, however, severely restricts the types of inks that can be used in inkjet printing systems. Another approach is to use special media that promotes fast adherence of inks thereto. This approach may be very restrictive since special media (e.g., specially purchased paper) may be required when printing with a desired print quality.

Another approach for addressing the above problems is to use a treatment fluid. For example, via a treatment fluid, fixer may be applied on inked dots. The fixer may prevent ink to spread beyond locations where it is deposited. Fixer deposition for addressing bleeding and/or feathering may include blooming in order to add robustness against printer misalignment. By blooming fixer is also applied to substrate locations surrounding inked dots. Other treatment fluids may be used. For example a coating may be applied on inked dots to address at least some of the above problems or to provide a protecting coating to a printed pattern.

Applying treatment to a substrate may, however, cause some undesirable effects. Applying too much treatment to each dot location can cause the medium to warp or cockle. Using too much treatment may also unacceptably increase print costs. On the other hand, using too little treatment may not achieve the desired print quality and, more specifically, negatively affect some printing output parameters such as, chroma, water fastness, strike through avoidance, and edge sharpness.

In order to address problems related to treatment application, it has been elsewhere proposed to apply on a substrate location a variable amount of treatment, the treatment amount depending on a quantity of ink to be applied to the substrate location. However, variable treatment application may not be efficient at high ink densities since there deposition of treatment beyond a certain amount may not convey any substantial improvement in print quality.

It has also been proposed to apply a constant amount of treatment. However, at low ink densities, the percentage of deposited treatment relative to deposited ink may be too high resulting in deposition of more treatment that actually required. This might result on unnecessary waste of treatment and/or undesired effects due to the relatively high amount of treatment relative to ink.

In at least some of the examples herein, printing methods are disclosed that facilitate an efficient deposition of treatment. For substrate locations with a relatively low ink density, a treatment is variably applied in order to avoid an excess of treatment fluid. This might be seen as a variable treatment-to-ink regime. Blooming may be omitted at the relatively low ink densities since, for those ink densities, bleeding and/or feathering may not be perceivable.

On the other hand, for substrate locations with a relatively high ink density, an efficient treatment usage may be provided by applying a constant treatment amount (this might be seen as a constant treatment-to-ink regime) and combining it with blooming. A constant treatment amount refers to applying an amount of treatment irrespective of how much the ink amount exceeds the threshold. Blooming, as used herein refers to depositing treatment on dot locations surrounding a dot location identified to receive a certain amount of ink. Blooming may be restricted to substrate dot locations that are not determined to receive ink. Further, printing may be performed such that all substrate dot locations to receive treatment via blooming are to receive the same amount of treatment. In other examples, blooming is not restricted to substrate dot locations that are not determined to receive ink.

Such examples combine the benefits of (1), applying treatment variably, i.e., with a treatment amount adapted to the local ink conditions, and (2) constantly applying treatment using blooming for robustness. Further, such examples consider when one of these approaches conveys the most benefits. More specifically, such examples facilitate an efficient usage of treatment by taking into account a threshold that determines when using one of approaches (1) or (2) is more effective. Further, such a treatment application can be implemented in a computational efficient manner. It should be taken into account that due to required print speeds, computational capabilities for determining treatment application may be significantly limited.

The following description is broken into sections. The first, labeled "Environment," describes environments in which examples may be implemented. The second section, labeled "Components," describes various physical and logical components for implementing various examples. The third section, labeled a "Operation," describes steps taken to implement various embodiments.

Environment: FIG. 1 is a block diagram of a printer 100, in which examples can be implemented. It will be understood that the following description of printer 100 is merely illustrative and does not limit the components and functionality of examples described in the present disclosure.

As shown in the diagram, printer 100 includes a carriage 102 with a printhead receiving assembly 104. In the illustrated example, printer 100 is illustrated including printhead 106 in printhead receiving assembly 104. Carriage 102 is to transition printhead 106 across the width of a substrate 108, i.e., along printhead transition directions 110, 112. For example a drive 146 may be coupled to carriage 102 for effecting carriage transition. Thereby, printer 100 can perform printing across a width of substrate 108 via translation of carriage 102. In other examples, printhead 106 is a page-wide array printhead and translation is not required for printing across a width of substrate 108.

Printhead 106 in this example is illustrated to include a plurality of ink printhead units 114, 116, 118, 120. Each of the ink printhead units is configured to eject ink 122 of a different color via respective ink nozzle array arrangement 124, 126, 128, 130. Ink printhead units 114, 116, 118, 120 are fluidly connected to an ink reservoir system 132. Ink reservoir system 132 includes ink reservoirs 132*a*, 132*b*, 132*c*, 132*d* for providing ink to the respective ink printhead units. In the illustrated example, ink reservoirs 132*a*, 132*b*, 132*c*, 132*d* respectively store cyan ink, magenta ink, yellow ink, and black ink.

Base colors may be reproduced on substrate 108 by depositing a drop of one of the above mentioned inks onto a substrate location. Further, secondary colors can be reproduced by combining ink from different ink printhead units. In particular, secondary or shaded colors can be reproduced by depositing drops of different base colors on adjacent dot locations in the substrate location (the human eye interprets the color mixing as the secondary color or shading). It will be understood that further ink reservoirs may be provided. For example, a CcMmKY system may include further ink reservoirs for light cyan (c) and light magenta (m).

According to some examples herein, printer 100 may include at least one printhead unit for ejecting a pre-treatment fluid 146*a* and/or at least one printhead unit for ejecting a post-treatment fluid 146*b*. In the example of FIG. 1, treatment printhead units 134, 136 are for treating a substrate location (e.g., any of substrate dot locations 504 depicted in FIG. 5B). Treatment printhead unit 134 is for applying a pre-treatment 146*a* (e.g., a fixer) on the substrate location via a pre-treatment nozzle arrangement 138. More specifically, in at least some examples herein, a treatment fluid to be deposited is a fixer. A fixer fluid may be configured as described in U.S. Pat. Nos. 4,694,302, 5,746,818, or 6,132,021, which are incorporated by reference.

Treatment printhead unit 134 is for applying a post-treatment 146*b* (e.g., a coating) on the substrate location via a post-treatment nozzle arrangement 142. A post-treatment may be as described by U.S. patent application Ser. No. 12/383,066 published under publication number US 2012/0120142.

The block diagram in FIG. 1 shows treatment printhead units 134, 136 fluidly connected to, respectively, a pre-treatment fluid reservoir 140*a* and a post-treatment fluid reservoir 140*b*. Treatment fluid reservoirs 140*a*, 140*b* are to store the treatment fluid to be jetted by treatment nozzles 138, 142. For example, pre-treatment fluid reservoir 140*a* may store a printing fluid including an ink fixer component; post-treatment fluid reservoir 140*b* may store a printing fluid including a coating component. Ink reservoir system 132 and treatment fluid reservoirs 140*a*, 140*h* may include disposable cartridges (not shown). The reservoirs may be mounted on carriage 102 in a position adjacent to the respective printhead. In other configurations (also referred to as off-axis systems), the reservoirs are not mounted on carriage 102 and a small fluid supply (ink or treatment) is externally provided to the printhead units in carriage 102; main supplies for ink and fixer are then stored in the respective reservoirs. In an off-axis system, flexible conduits are used to convey the fluid from the off-axis main supplies to the corresponding printhead cartridge. Printheads and reservoirs may be combined into single units, which are commonly referred to as "pens".

It will be appreciated that examples can be realized with any number of printhead units depending on the design of the particular printing system, each printhead unit including a nozzle array for jetting a printing fluid such as ink or treatment. For example, printer 100 may include at least one treatment printhead unit, such as two or more treatment printhead units. Furthermore, printer 100 may include at least one ink printhead unit, such as two to six ink printhead units, or even more ink printhead units.

In the illustrated examples, ink printhead units are located at one side of a treatment printhead. It will be understood that ink printheads may be located at both sides of a treatment printhead. Further, printhead units might be monolithically integrated in printhead 106. Alternatively, each printhead unit might be modularly implemented in printhead 106 so that each printhead unit can be individually replaced. Further, printhead 106 may be a disposable printer element or a fixed printer element designed to last for the whole operating life of printer 100.

Printer 100 further includes a controller 148, which is operatively connected to the above described elements of printer 100. Controller 148 is shown configured to execute a print job received from a printout source 150 according to control data 105. Via control data 105 it might be determined whether, for one or more substrate location, how treatment fluid is to be ejected, e.g. whether according to a variable treatment-to-ink regime or to a constant treatment-to-ink regime. Control data 105 may be generated based on data for print job source 150. Further, control data 105 may be generated by print job source 150 and provided to controller 148. Controller 148 is shown to include processor 154. Processor 154 is configured to execute methods as described herein. In some examples, printer 100 includes an application-specific integrated circuit (ASIC) configured to generate control data 105 as illustrated by examples herein.

Processor 154 may be implemented, for example, by one or more discrete modules (or data processing components) that are not limited to any particular hardware, firmware, or software (i.e., machine readable instructions) configuration. Processor 154 may be implemented in any computing or data processing environment, including in digital electronic circuitry, e.g., an application-specific integrated circuit, such as a digital signal processor (DSP) or in computer hardware, firmware, device driver, or software (i.e., machine readable instructions). In some implementations, the functionalities of the modules are combined into a single data processing component. In other versions, the respective functionalities of each of one or more of the modules are performed by a respective set of multiple data processing components.

Memory device 152 is accessible by controller 148 and, more specifically, by processor 154. Memory device 152 may be integrated within controller 148 or may be a separate component communicatively connected to controller 148. Memory device 152 stores process instructions (e.g., machine-readable code, such as computer software) for implementing methods executed by controller 148 and, more specifically, by processor 154.

Program instructions in memory device 152 may be part of an installation package that can be executed by processor 154 to implement control engine 108. In this case, memory 152 may be a portable medium such as a CD, DVD, or flash drive or a memory maintained by a server from which the installation package can be downloaded and installed. In another example, the program instructions may be part of an application or applications already installed. Here, memory 152 can include integrated memory such as a hard drive. It should be noted that a tangible medium as used herein is considered not to consist of a propagating signal. In examples, the medium is a non-transitory medium.

Controller 148 receives print job commands and data from print job source 150, which may be a computer or any other source of print jobs, in order to print an image based on a print mask. The received data may include treatment control data 105. A print mask refers to logic that includes control data determining which nozzles of the different printheads are fired at a given time to eject fluid in order to reproduce a print job. The print mask may be processed according to control data 105 by processor 154 in order to cause ejection of treatment according to examples herein. In an example, control data 105 forms part of a print mask supplied by print job source 150. Alternatively, control data 105 might be implemented in the print mask by a pre-processing performed by processor 154, or any other processor, so that treatment is ejected as disclosed herein.

Controller 148 is operatively connected to treatment printhead units 134, 136, ink printhead units 114, 116, 118, 120, and the respective reservoirs to control, according to the print mask and the control data in memory 152. Thereby, controller 148, and more specifically processor 154, can control functionality of printer 100 such as, but not limited to printing according to control data 105.

It will be understood that the functionality of memory 152 and print job source 150 might be combined in a single element or distributed in multiple elements. Further, memory 152 and print job source 150 may be provided as external elements of print system 100. Further, it will be understood that operation of processor 154 to control treatment ejection is not limited to the above examples.

Components: At least some of the functionality described herein can be implemented as components comprised of a combination of hardware and programming configured for performing tasks described herein (for example, blocks in the flow charts illustrated below with respect to FIGS. 3 and 4).

Figure 2:
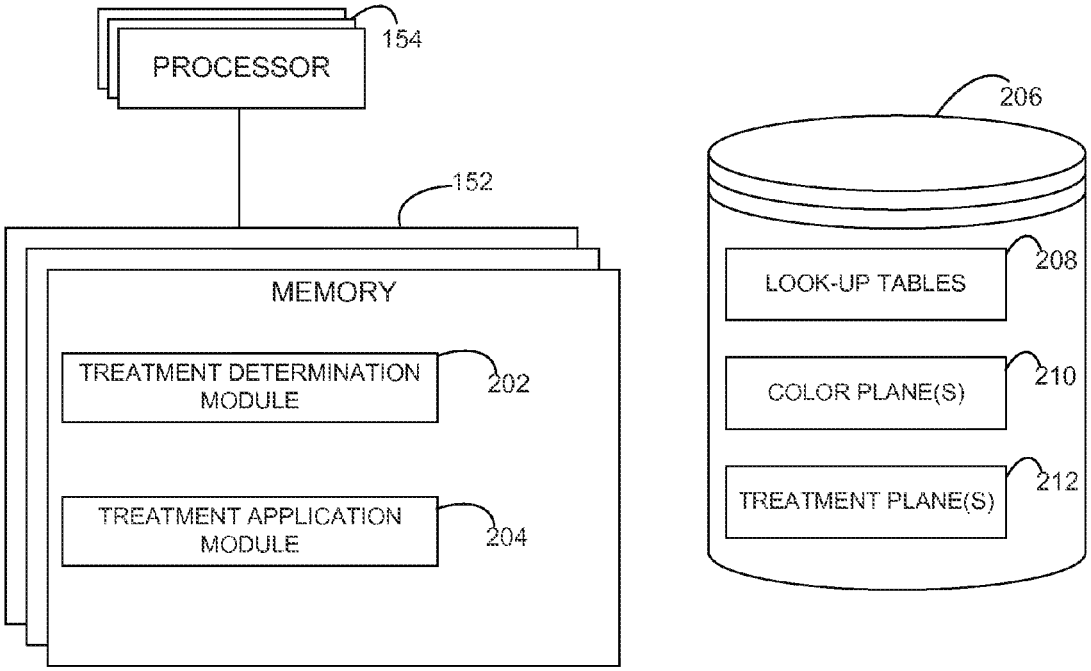
FIG. 2 is a block diagram schematically illustrating components for implementing examples.

FIG. 2 depicts examples of physical and logical components for implementing examples illustrated herein. In illustrating FIG. 2, reference is made to printer 100 in FIG. 1. It will be understood that this reference is merely illustrative and does not limit components of examples herein.

In the example of FIG. 2, the programming may be processor executable instructions stored on a tangible memory media, e.g., memory 152 and the hardware may include processor 154 for executing those instructions. Memory 152 can be said to store program instructions that when executed by processor 154 implements, at least partially, controller 148 shown in FIG. 1. Memory 152 may be integrated in the same device as processor 154 or it may be separate but accessible to that device and processor 154. Memory 152 and processor 154 may be respectively comprised of single, integrated components or may be distributed over a number of discrete memory units and processor units. Such discrete memory units and processor units may be included in the same integrated component (e.g., controller 148) or may be distributed over different, communicatively connected, components (e.g., a controller comprised of multiple discrete components).

Program instructions in memory 152 may be part of an installation package that can be executed by processor 154 to implement examples herein. In this case, memory 152 may be a portable medium such as a CD, DVD, or flash drive or a memory maintained by a server from which the installation package can be downloaded and installed. In another example, the program instructions may be part of an application or applications already installed. Here, memory 152 can include integrated memory such as a hard drive. It should be noted that a tangible medium as used herein is considered not to consist of a propagating signal. In examples, the medium is a non-transitory medium.

In FIG. 2 the executable program instructions stored in memory 152 are depicted as a treatment determination module 202 and a treatment application module 204. It will be understood that these modules may be combined or configured differently as shown in FIG. 2 for realizing examples herein.

Figure 6:
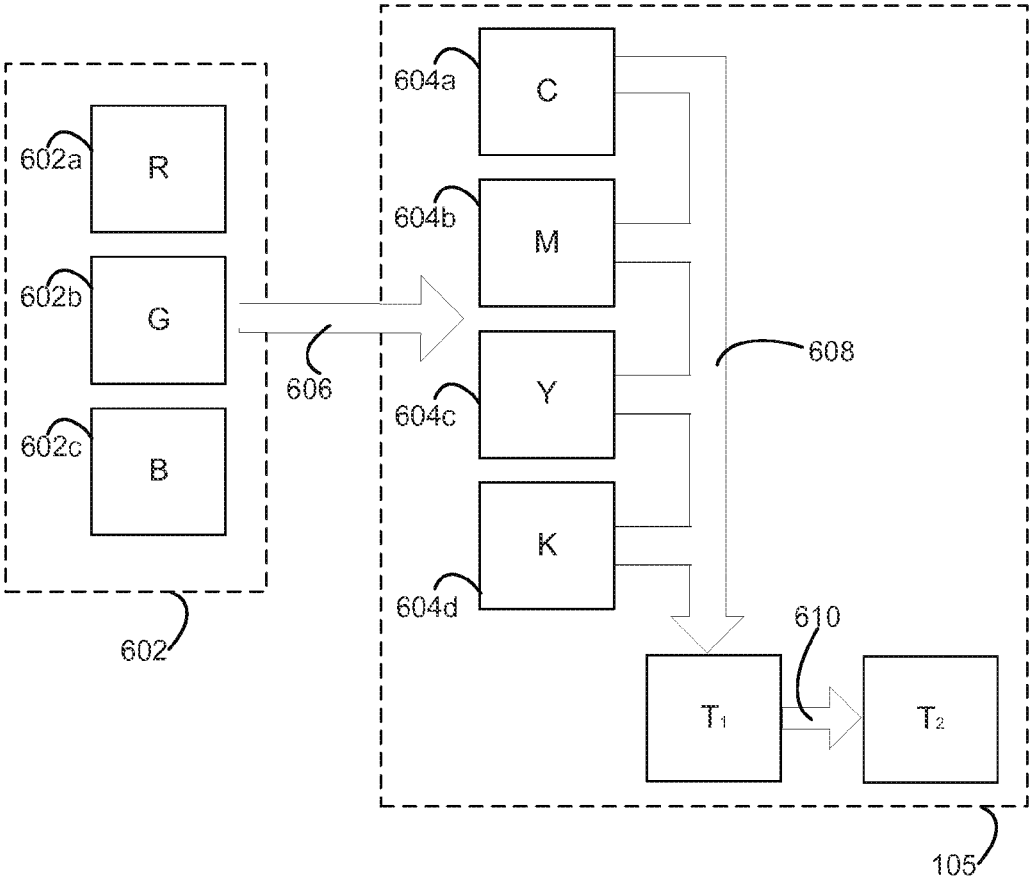
FIG. 6 shows a generation of control data according to examples.

Treatment determination module 202 is configured to determine how treatment fluid is to be deposited. Treatment determination module 202 may be configured to process treatment ejection data that specifies operation of a treatment printhead. For example, treatment determination module 202 may merely process treatment control data 105 (illustrated above with respect to FIG. 1). Alternatively, or in addition thereto, treatment determination module 202 is configured to generate treatment control data 105 based on image data (example image data 602 is shown in FIG. 6). Generation of control data is illustrated below with respect to FIG. 3.

For generating control data 105, module 202 may access look-up tables 208, stored in data store 206. Look-up tables 208 may be designed to transform image data (e.g., RGB data 602*a*-602*c* shown in FIG. 6 below) into printer control data 105. Printer control data 105 may be comprised of color plane(s) 210, which determines in which substrate dot locations ink is to be deposited, and treatment plane(s) 212, which determines in which substrate dot location treatment is to be deposited. Color plane(s) 210 and treatment plane(s) 212 may be also stored in data store 206. Data store 206 represents, generally, any memory capable of storing data that can be accessed by form fill device in the performance of its functions. Generation of color and treatment planes is illustrated below with regard to FIG. 6.

Treatment application module 204 is configured to cause a printer, e.g., printer 100 in FIG. 1, to apply treatment as described herein. For example, module 204 may receive treatment control data 105 from treatment determination module 202 and cause printer 100 to apply the treatment in individual substrate dot locations accordingly. Treatment application is illustrated below with respect to FIG. 4.

Figure 3:
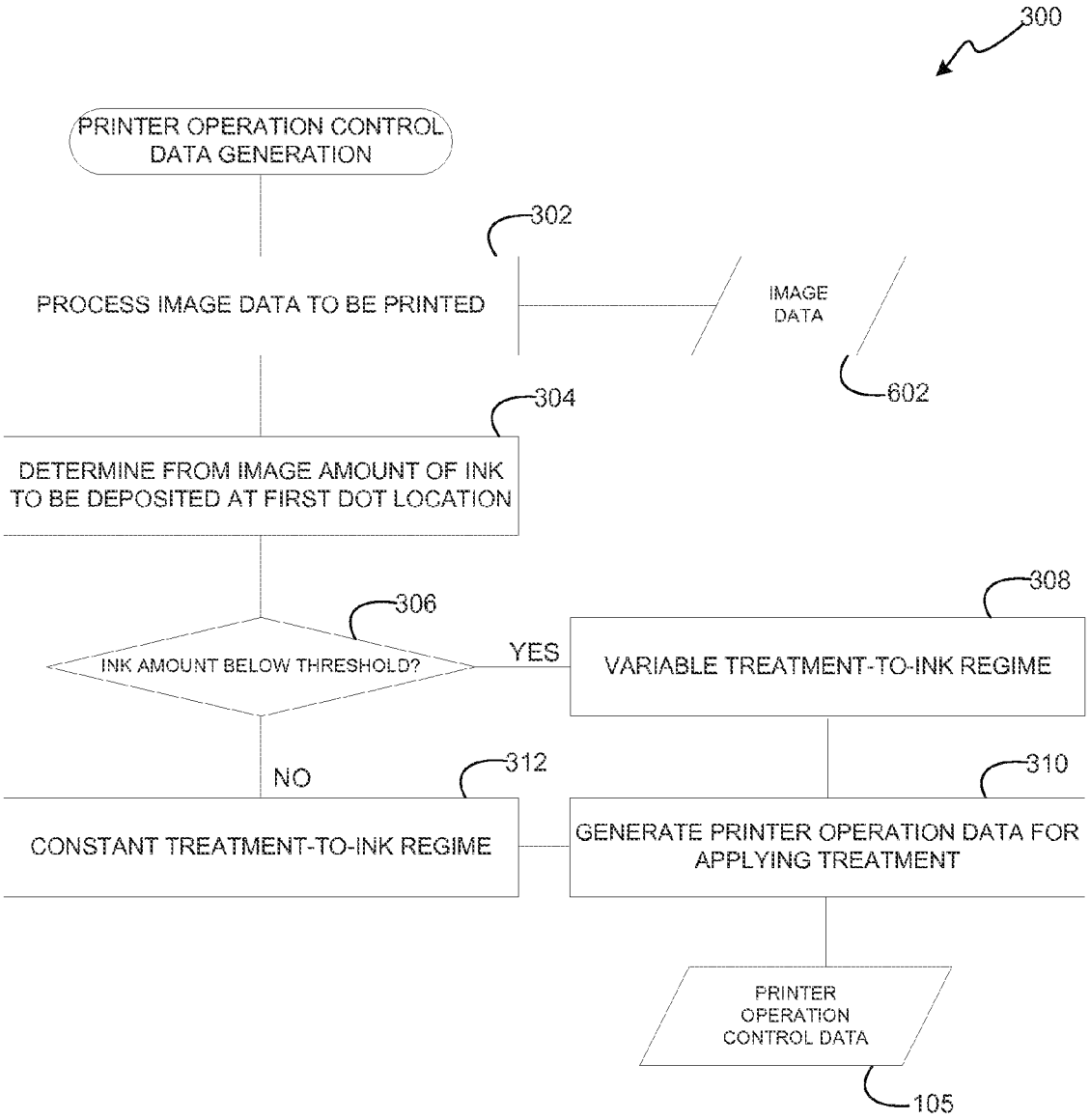
FIG. 3 is a flow chart that implements examples of printer operation control data generation.
Figure 4:
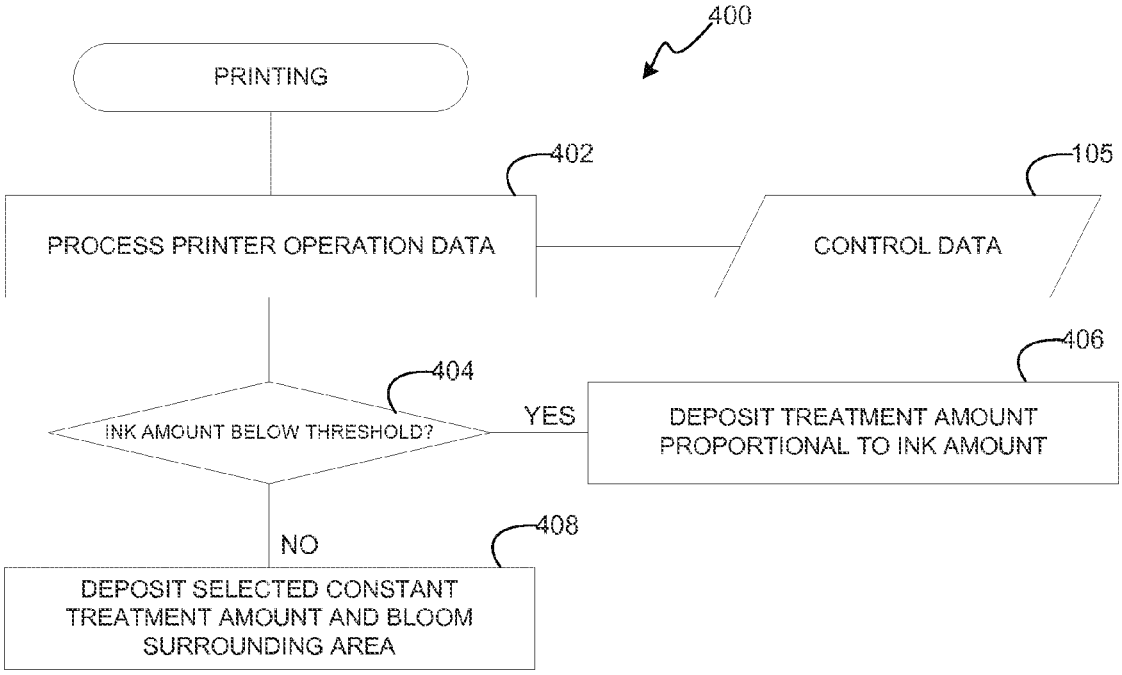
FIG. 4 is a flow chart that implements examples of image printing.

Operations: FIGS. 3 and 4 show flow charts illustrating examples. In discussing FIGS. 3 and 4, reference is made to FIGS. 1 and 2 to provide contextual examples. Implementation, however, is not limited to those examples. Reference is also made to the example forms depicted in FIGS. 5 to 8B. Again, such references are made simply to provide contextual examples.

FIG. 3 shows a flow chart 300 that implements examples of methods for generating printer operation control data (e.g., control data 105 shown in FIG. 5). Blocks in flow chart 300 may be executed by controller 148, shown in FIG. 1. In an example, blocks in flow chart 300 are implemented by treatment determination module 202 illustrated above with respect to FIG. 2.

At block 302, an image to be printed is processed. The processing at block 302 may include receiving image data 602 to be printed by printer 100. The image data may be provided by a computing system externally connected to printer 100 via a physical connection (e.g., a USB cable or the like), or a wireless connection (via a wireless local area network). Image data may be comprised of a set of rot, green, blue (ROB) values for each pixel on the image (e.g., image data 602 shown in FIG. 6). At block 302, RCB values associated with a specific substrate dot location may be identified from image data 602 and made available for the ink amount determination at block 304.

Figure 5A:
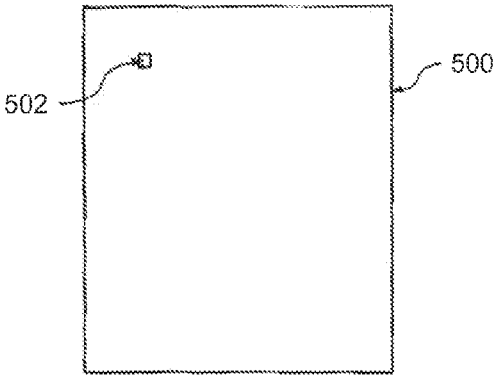
FIG. 5A schematically shows a substrate according to examples.

In the present description, a substrate dot location is understood as an area of a substrate onto which a pixel of an image is to be reproduced. FIG. 5A illustrates a substrate 500 on which printer 100 may print an image. Substrate 500 can be a sheet of paper, a transparency, or any other medium which is suitable for printing, such as a textile or a banner substrate. A small section 502 of substrate 500 is indicated in FIG. 5A.

Figure 5B:
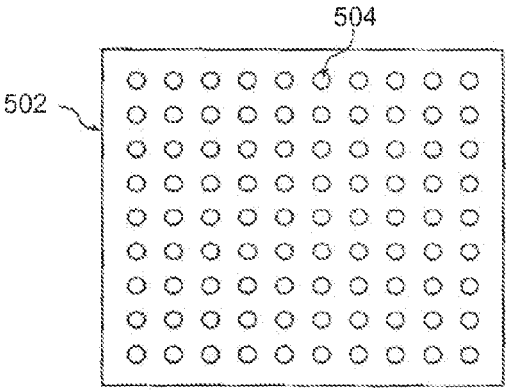
FIG. 5B schematically shows a portion of the substrate in FIG. 5A.

FIG. 5B shows a close up view of section 502 of substrate 500. Section 502 is comprised of substrate dot locations 504 locations where ink and/or treatment may be applied to reproduce the image. In general, the number and size of substrate dot locations 504 are not limited. For example, in certain applications, there might be 300 dot locations per inch in both the vertical and horizontal direction of substrate 500. In such an example, the spacing between each dot location 504 may be 1/300 of an inch. In other examples, there may be 600 or 1200 dot locations per inch. The spacing between the dot locations in such examples may be 1/600 of an inch and 1/1200 of an inch, respectively.

Referring back to FIG. 3, at block 304, from the image processed at block 302, an amount of ink to be deposited at a first dot location 504 on substrate 500. First dot location 504 may be any of the substrate dot locations shown in FIG. 5B. Block 302 may involve a color conversion from image data to the color space of the printer. In other words, pixel data of the image may be translated to the color gamut of the printer to be used. For example, image data 602 shown in FIG. 6 may be converted to CMYK values 604*a*-604*d* corresponding to the color space of printer 100. From the CMYK values, ink amounts to be deposited on single dot locations can be derived. It will be understood that this derivation may include some processes such as printer channel linearization and/or halftoning.

At block 306, the ink amount determined at block 304 is compared to a threshold to determine a treatment-to-ink regime.

In examples herein, the threshold is an ink amount limit that may be pre-determined based on one or more factors. Generally the threshold is pre-determined as the ink amount limit above which depositing a constant treatment amount and blooming is sufficient to satisfy certain print quality requirements. In such examples, below the pre-determined ink amount limit blooming may not provide any significant advantage and a proportional deposition of amount of ink facilitates an efficient usage of treatment.

In general, a trial-and-error approach may be used to determine a threshold that is suitable for a required print quality requirement. For example, the threshold may be determined via experimentation by printing test patches using different ink amounts. The printed test patches may be a sequence that starts with a low ink amount and successively increases ink amounts. For printing the test patches, variable and constant treatment-to-ink regimes may be interleaved. Thereby, it might be assessed ink amounts for which print quality is satisfactory or not for different treatment-to-ink regimes.

Alternatively, or in addition thereto, the above procedure may be performed varying print parameters (e.g., used inks, substrates, or printing conditions such as temperature or humidity). Thereby, a threshold may be determined specific to certain print parameters such as printing conditions, used inks, or used substrates. It will be understood that a value of the threshold may be pre-determined in a number of manners.

In an example, if the treatment fluid includes a fixer, above the pre-determined threshold (for example, an ink amount limit between 1 and 4 drop-per-pixels, dpp, such as 2 dpp), applying a constant fixer amount is determined to be sufficient for controlling ink migration; further, below the pre-determined threshold, applying bleeding is determined not to convey a significant advantage since the low ink amount to be deposited does not cause a significant bleeding effect; further, below the pre-determined threshold, applying a variable fixer (e.g., a fixer amount proportional to ink to be deposited) is determined to be a more efficient usage of treatment.

Referring back to FIG. 3, at block 306 it is assessed whether the ink amount is below a threshold. It will be understood that other equivalent comparisons are feasible. For example, it might be assessed whether the ink amount is greater than the threshold. Process flow 300 may be then accordingly adapted.

In the example illustrated in FIG. 3, if at block 306 it is assessed that the ink amount is below the threshold, then process flow 300 goes to blocks 308 and 310, where printer operation control data 105 for applying treatment according to a variable treatment-to-ink regime is generated. A variable treatment-to-ink regime refers to generating control data in which treatment to be deposited on the substrate dot location is selected to be dependent on the ink amount. For example, the treatment to be deposited in the substrate dot location may be selected to be proportional to the ink amount, as illustrated below with respect to FIGS. 8A and 8B. Further examples on variable treatment application are illustrated in U.S. patent application entitled "Print", by Marc Rossinyol Casals et al, with application Ser. No. 13/229,186, filed on Sep. 9, 2011 and assigned to the present assignee.

If at block 306 it is assessed that the ink amount is not below the threshold, then process flow 300 goes to blocks 312 and 310 where printer operation control data 105 for applying treatment according to a constant treatment-to-ink regime is generated. A constant treatment-to-ink regime includes applying bloom in dot locations surrounding the first dot location.

In a constant treatment-to-ink regime, a selected constant treatment amount is deposited. In other words, for any amount of ink exceeding the threshold, the same treatment amount is deposited on the substrate dot location. The selected constant treatment amount to be deposited when the ink amount is above a threshold is, generally, a treatment amount that is sufficient to address issues caused by ink mobility. In an example, the selected constant treatment amount is a maximal treatment amount. The maximal treatment amount may be determined by the capacity of printer 100 to deposit treatment during a pass over the substrate location for printing on a single dot. Printer 100 may be designed so that maximal treatment amount is a certain percentage of the maximal amount of ink that can be deposited on a single substrate location, e.g. a percentage between 5 and 15% of the maximal ink amount such as 8%.

There are a variety of options for applying blooming. Some examples on how blooming may be applied are illustrated in, for example, U.S. Pat. No. 6,598,965, which is incorporated herein by reference in its entirety (to the extent in which this document is not inconsistent with the present disclosure) and in particular those parts thereof describing blooming. In some example, in the constant treatment-to-ink regime, the same treatment amount is to be applied to the first dot location and to dot locations surrounding the first dot location used at block 304 onto which blooming is applied.

Process flow 300 illustrates treatment deposition onto a single substrate dot location. It will be understood that process flow 300 may be extended for generating control data for all substrate dot locations that are to be printed for reproducing a complete image. Thereby, complete sets of data might be generated that determines where and how treatment is to be applied. Printer 100 may address these data sets to apply treatment for reproducing a complete image on a substrate.

It will be understood that there are a variety of options for generating printer operation control data. Some examples for generating control data for applying treatment on a substrate are illustrated in, for example, U.S. Pat. No. 6,598,965, which is incorporated herein by reference in its entirety (to the extent in which this document is not inconsistent with the present disclosure) and in particular those parts thereof describing circuits for treatment data generation.

Control data generation may imply generating one or more treatment planes indicating printing system 100 where to apply treatment. Such examples of control data generation are illustrated in the following with respect to FIG. 6. FIG. 6 illustrates generation of control data 105 for operating printer 100 to deposit treatment fluid. In the example illustrated in FIG. 6, control data 105 also includes data for operating printer 100 to deposit inks.

The basis for control data generation is image data 602. Image data 602 is comprised of a plurality of pixels, each pixel having associated thereto a RGB value. Therefore, image data 602 can be seen as being comprised of three color planes: a red (R) plane 602*a*, a green (G) plane 602*b*, and a blue (B) plane 602*c*. Image data 602 may be color converted to generate color planes corresponding to the color gamut of printer 100. For example, a color conversion 606 may be used to transform the RGB planes 602*a*-602*c* into CMYK planes 604*a*-604*d*. Each CMYK plane may be comprised of ink amount values to be applied on substrate dot locations for reproducing the image associated to image data 602. If the printer includes further ink channels (e.g., a light cyan and/or a light magenta channel), further corresponding planes may be generated.

There are a variety of options for storing ink amount values in CMYK planes 604*a*-604*d*. For example, ink amount values may be stored as 8 bit values associated to specific substrate dot locations. These ink amount values can then be used as input values for printhead units 114, 116, 118, 120 when positioned over the corresponding substrate dot locations.

Color conversion 606 is configured depending on the specific requirements of the particular printing systems. For example, color conversion 606 may be comprised of look-up tables (e.g., look-up tables 208 shown in FIG. 2) addressing image data 602 for generating CMYK planes 604*a*-604*d*. Such look-up tables may, additionally to color conversion, perform further conversion operations such as, but not limited to, linearization and halftoning.

Ink amounts to be deposited on substrate dot locations can be derived from CMYK planes 604*a*-604*d* and used to build one or more treatment planes for determining where and under which treatment-to-ink regime a treatment printhead unit (e.g., any of treatment printhead units 134 and 136 shown in FIG. 1) is to deposit treatment. In examples, treatment planes may be built for accomplishing each treatment-to-ink regime. Each of the treatment planes may be associated to different deposition units. For example, a treatment plane may be built comprising data for causing a treatment deposition unit to deposit treatment according to the variable or constant treatment-to-ink regime. Another treatment plane may be built comprising data for causing deposition of treatment in bloomed locations.

Figure 7:
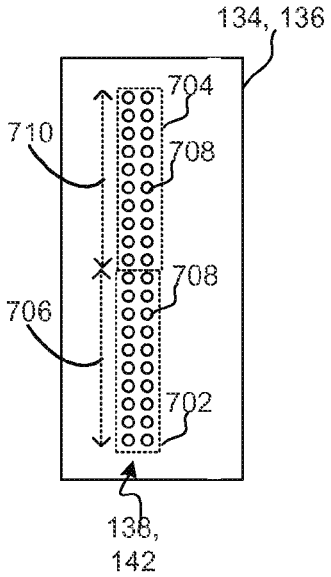
FIG. 7 schematically shows details of a treatment deposition unit according to examples.

These deposition units refer to treatment deposition units that are separately addressable for deposition of treatment. For example, as illustrated by FIG. 7 one or both of printhead units 134 and 136 of printer 100 may include a first trench 702 to deposit treatment according to a first treatment plane and a second trench of 704 to deposit treatment according to a second treatment plane. First trench 702 is comprised of a first set 706 of nozzles 708. Second trench 704 is comprised of a second set 710 of nozzles 708. It will be understood that the deposition units may be implemented differently. For example, deposition units may be implemented by separate printhead units that independently addressable.

Referring back to FIG. 6, a first treatment plane $T_1$ is built via an ink-to-treatment transform 608 that addresses data from CMYK planes 604*a*-604*d*. In an example, ink-to-treatment transform 608 is such that first treatment plane $T_1$ contains data for causing a deposition unit to deposit treatment according to the variable treatment-to-ink regime or to the constant treatment-to-ink regime. For example, first treatment plane $T_1$ may be built via transform 608 to cause (1) treatment deposition proportional to the local amount of ink in substrate dots with an ink amount below a threshold, and (2) constant treatment deposition in substrate dots with an ink amount above the threshold.

In an example, if the ink amount associated via CMYK planes 604*a*-604*d* to a substrate dot location is below a threshold (e.g., 2 dpp), the treatment in a corresponding location in plane $T_1$ is set to be proportional to the ink amount. If the ink amount associated via. CMYK planes 604*a*-604*d* to a substrate dot location exceeds the threshold, the treatment in a corresponding location in plane $T_1$ is set to a maximum value possible. Then halftoning may be performed at the threshold value, so that $T_1$ is comprised of (1) areas with low half-toned values (e.g. 0 or 1), where ink is low and treatment is to be applied proportional to ink, and (2) areas with high half-toned values (e.g. 3), where ink is above the threshold, and treatment is to be applied under a constant treatment-to-ink regime. $T_1$ may be then processed using a special mask (e.g., using a LUT), so that the half-toned values are printed.

The resulting plane $T_1$ may be addressed by a further transform 610 for generating a second treatment plane $T_2$ for causing a second treatment deposition unit to deposit treatment in bloomed locations surrounding locations associated with the constant treatment-to-ink regime. Transform 610 may populate second treatment plane $T_2$ for blooming areas in first treatment plane $T_1$ that correspond to a constant treatment-to-ink regime.

Each of the resulting planes $T_1$ and $T_2$ are then to be printed with a different trench 702 or 704 in treatment print units 134, 136. Thereby, a computationally efficient generation of treatment can be implemented via the generation of multiple treatment planes. It will be understood that there are other options for generation the treatment deposition data. For example, a single treatment plane can be built by combining each of the resulting planes $T_1$ and $T_2$. Such a single treatment plane can then be used to operate a single treatment deposition unit implementing both treatment-to-ink regimes.

In the following, treatment deposition is illustrated with respect to FIG. 4. FIG. 4 shows a flow chart 400 that implements examples of methods for printing on substrate dot locations 504. Blocks in flow chart 400 may be executed by controller 148, shown in FIG. 1. In an example, blocks in flow chart 400 are implemented by treatment application module 204 illustrated above with respect to FIG. 2.

At block 402, control operation data 105 is processed. For example, data generated via process flow 300 may be accessed and made readily available to controller 148 for operation of one or more of treatment printhead units 134, 136 in FIG. 1. Control operation data 105 may include data for operating ink printhead units, e.g., one or more of printhead units 114, 116, 118, 120 in FIG. 1.

As represented by block 404, the manner on which treatment application is applied depends on whether an ink amount to be applied on a substrate dot location 504 is above or below the threshold mentioned above.

If the ink amount to be deposited in a substrate dot location is below a threshold, the selected treatment-to-ink regime includes depositing at block 406 an amount of treatment in that substrate dot location. In the specific example of FIG. 4, for low ink amounts, the treatment amount is proportional to the ink amount. As set forth above, other treatment-to-ink dependencies are foreseen for low ink amounts (e.g., an exponential treatment-to-ink dependency).

If the ink amount to be deposited in a substrate dot location is above the threshold, the selected treatment-to-ink regime includes depositing at block 408 a selected constant amount of treatment in the substrate dot location. Further, block 407 also includes blooming in an area surrounding the specific substrate dot location.

Figure 8A:
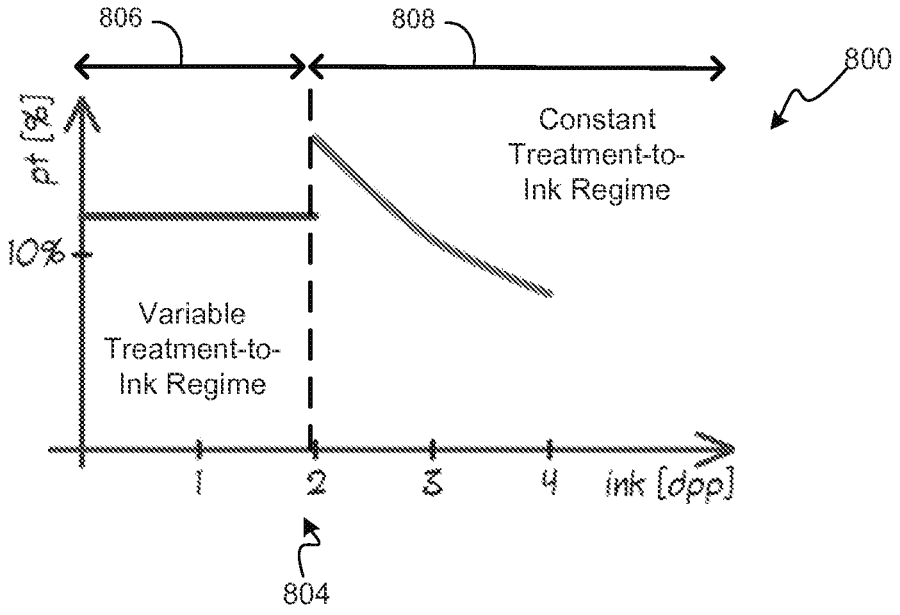
FIGS. 8A and 8B graphically illustrate treatment deposition according to the flow chart of FIG. 4.
Figure 8B:
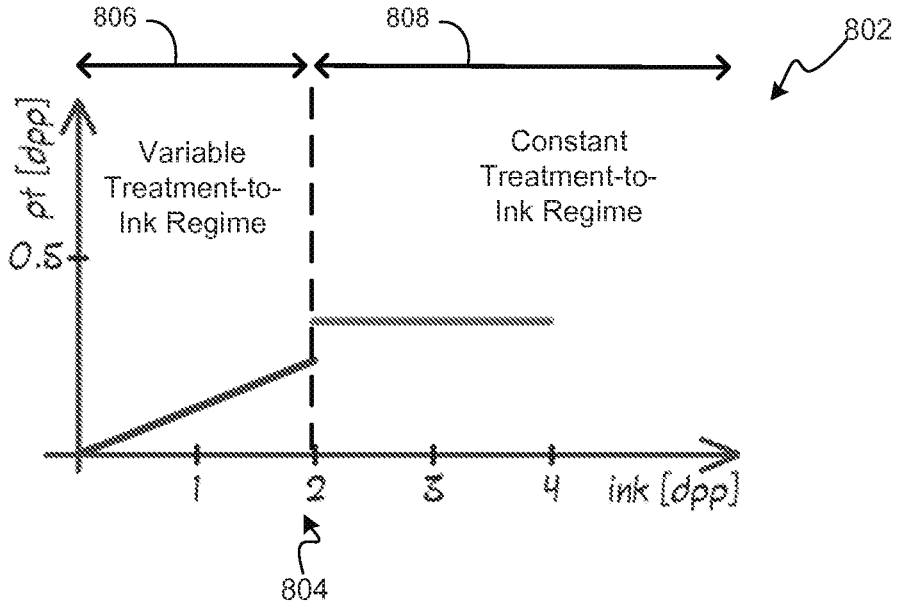

Treatment deposition according to flow chart 400 is graphically illustrated in FIGS. 8A and 8B. Graph 800 shows percentage of treatment (relative to ink amount) against ink amount (in drop-per-pixel units, dpp) to be deposited on substrate dot locations to receive ink. Graph 802 shows amount of treatment (in drop-per-pixel units, dpp) against ink amount (in drop-per-pixel units, dpp) to be deposited on a specific substrate dot location. In this example, a threshold 804 is set at 2 dpp. The threshold defines a variable treatment-to-ink regime 806 and a constant treatment-to-ink regime 808.

In this example, as shown in graph 800, 802, at variable treatment-to-ink regime 806, the amount of treatment to be deposited for low ink amounts (i.e., below threshold 804 at 2 dpp) is proportional to the ink amount. In the example, this proportionality is set to a fixed percentage of 12%. Such a variable treatment-to-ink regime facilitates that an efficient treatment is performed while preventing that too much treatment is applied at very low ink amounts.

Further, at constant treatment-to-ink regime 806, the amount of treatment to be deposited for high ink amounts (i.e., above threshold 804 at 2 dpp) is constant. Such a variable treatment-to-ink regime facilitates that an efficient treatment is performed for high ink amounts since, there, higher treatment might not provide substantial improvements in print quality, in particular in view of application of blooming to surrounding substrate dot locations. Further, it can be understood from FIG. 8A that if the constant treatment-to-ink regime would be extended to low ink amounts this would result in a high treatment amount relative to applied ink, which might negatively impact print quality due to treatment overflow.

Conclusion: In at least some of the examples above, techniques related to print treatment deposition are illustrated.

It will be appreciated that examples above can be realized in the form of hardware, programming or a combination of hardware and the software engine. Any such software engine, includes machine-readable instructions, may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage substrate are embodiments of a tangible computer-readable storage medium that are suitable for storing a program or programs that, when executed, for example by a processor, implement embodiments. Accordingly, embodiments provide a program comprising code for implementing a system or method as claimed in any preceding claim and a tangible or intangible computer readable storage medium storing such a program. A tangible computer-readable storage medium is a tangible article of manufacture that stores data. (It is noted that a transient electric or electromagnetic signal does not fit within the former definition of a tangible computer-readable storage medium.)

In the foregoing description, numerous details are set forth to provide an understanding of the examples disclosed herein. However, it will be understood that the examples may be practiced without these details. While a limited number of examples have been disclosed, numerous modifications and variations therefrom are contemplated. It is intended that the appended claims cover such modifications and variations. Further, flow charts herein illustrate specific block orders; however, it will be understood that the order of execution may differ from that which is depicted. For example, the order of execution of two or more blocks may be scrambled relative to the order shown. Also, two or more blocks shown in succession may be executed concurrently or with partial concurrence. Further, claims reciting "a" or "an" with respect to a particular element contemplate incorporation of one or more such elements, neither requiring nor excluding two or more such elements. Further, at least the terms "include" and "comprise" are used as open-ended transitions.

What is claimed is:

1. A computer software product comprising a tangible medium readable by a processor, the medium having stored thereon a set of instructions for generating printer operation control data, the instructions comprising:

a set of instructions which, when loaded into a memory and executed by the processor, causes processing of an image to be printed;

a set of instructions which, when loaded into a memory mad executed by the processor, causes determining from the image an amount of ink to be deposited at a first dot location on the substrate;

a set of instructions which, when loaded into a memory and executed by the processor, causes, if the ink amount is below a threshold, generation of printer operation control data for applying treatment according to a variable treatment-to-ink regime for depositing in the first dot location a variable amount of treatment dependent on the amount of ink; and a set of instructions which, when loaded into a memory mad executed by the processor, causes, if the ink amount is above the threshold, generation of printer operation control data for applying treatment according to a constant treatment-to-ink regime for depositing in the first dot location a selected constant amount of treatment that includes depositing treatment in dot locations surrounding the first dot location.

2. The product of claim 1, wherein in the variable treatment-to-ink regime, the treatment to be deposited on the substrate dot location increments with the ink amount.

3. The product of claim 1, wherein in the variable treatment-to-ink regime, the treatment to be deposited on the substrate dot location is selected to be proportional to the ink amount.

4. The product of claim 1, wherein in the constant treatment-to-ink regime, the treatment to be deposited in the location is a maximal treatment value.

5. The product of claim 1, wherein in the constant treatment-to-ink regime, the same treatment amount is to be applied to the first dot location and to dot locations surrounding the first dot location.

6. The product of claim 1, wherein, in the variable treatment-to-ink regime the treatment amount linearly depends on the ink amount.

7. The product of claim 1, further comprising instructions for generating a first treatment plane comprising data for causing a first treatment deposition unit to deposit treatment according to the variable treatment-to-ink regime or to the constant treatment-to-ink regime.

8. The product of claim 7, further comprising instructions for generating a second treatment plane comprising data for causing a second treatment deposition unit to deposit treatment in bloomed locations surrounding locations associated with the constant treatment-to-ink regime.

9. The product of claim 8, wherein:

the first treatment deposition unit is a first trench of a treatment printhead to deposit treatment according to the first treatment plane, and the second treatment deposition unit is a second trench of the treatment printhead to deposit treatment according to the second treatment plane.

* * * * *

UNITED STATES PATENT AND TRADEMARK OFFICE

CERTIFICATE OF CORRECTION

PATENT NO. : 8,985,735 B2
APPLICATION NO. : 13/852433
DATED : March 24, 2015
INVENTOR(S) : Jaime Fernandez del Rio et al.

It is certified that error appears in the above-identified patent and that said Letters Patent is hereby corrected as shown below:

In the Claims

In column 13, line 35, in Claim 1, delete “mad” and insert -- and --, therefor.

In column 14, line 2, in Claim 1, delete “mad” and insert -- and --, therefor.

Signed and Sealed this
Seventh Day of July, 2015

Michelle K. Lee

Michelle K. Lee
*Director of the United States Patent and Trademark Office*